US006736602B2

(12) United States Patent
Carney

(10) Patent No.: US 6,736,602 B2
(45) Date of Patent: May 18, 2004

(54) HOLLOW FAN HUB UNDER BLADE BUMPER

(75) Inventor: Gina L. Carney, Haddam Neck, CT (US)

(73) Assignee: United Technologies Corporation, Hartford, CT (US)

( * ) Notice: Subject to any disclaimer, the term of this patent is extended or adjusted under 35 U.S.C. 154(b) by 29 days.

(21) Appl. No.: 10/211,014

(22) Filed: Jul. 31, 2002

(65) Prior Publication Data

US 2004/0022634 A1 Feb. 5, 2004

(51) Int. Cl.[7] ..... F01D 5/32
(52) U.S. Cl. ..... 416/220 R
(58) Field of Search ..... 416/220 R, 219 R, 416/248, 500, 96 R, 97 R, 190, 221

(56) References Cited

U.S. PATENT DOCUMENTS 929,234 A * 7/1909 Mather
2,751,189 A * 9/1956 Ledwith
3,759,633 A * 9/1973 Tournere ..... 416/220
3,986,779 A * 10/1976 Beckershoff ..... 403/20
4,265,595 A * 5/1981 Bucy, Jr. et al. ..... 416/220 R
4,743,166 A * 5/1988 Elston, III et al. ..... 416/215
4,767,247 A * 8/1988 Partington et al. ..... 416/193 A
5,044,886 A * 9/1991 Stenneler ..... 416/215
5,236,309 A * 8/1993 Van Heusden et al. ..... 416/221
5,919,032 A * 7/1999 Naudet et al. ..... 416/216
5,993,162 A * 11/1999 Weisse et al. ..... 416/219 R

* cited by examiner

*Primary Examiner*—Edward K. Look
*Assistant Examiner*—James McAleenan
(74) *Attorney, Agent, or Firm*—Bachman & LaPointe, P.C.

(57) ABSTRACT

An attachment system for joining a blade to a hub is described. The system comprises a blade slot in the hub, a rail system positioned within the blade slot, a root portion of a blade positioned within the slot, and a bumper cooperating with the rail and contacting the blade root portion. The bumper has a central portion with first and second sides, a first pair of arms extending from the first side, and a second pair of arms extending from the second side. The central portion of the bumper includes a tab for positioning the bumper within a blade slot.

11 Claims, 2 Drawing Sheets

HOLLOW FAN HUB UNDER BLADE BUMPER

BACKGROUND OF THE INVENTION

The present invention relates to an attachment system for joining a fan blade to a hub and more particularly to an under blade bumper used therein.

Relative motion between a fan blade and its hub attachment is highly undesirable. Such movement can lead to excessive blade root wear as well as fan blade tip jams, blade shroud shingling, and premature fan hub retirement due to excessive wear.

SUMMARY OF THE INVENTION

Accordingly, it is intended to provide an improved attachment system for joining a fan blade to a hub.

It is a further object of the present invention to provide a bumper for use in said attachment system, which bumper minimizes movement in the fan blade to hub attachment.

The foregoing objects are attained by the attachment system and the bumper of the present invention.

In accordance with the present invention, an attachment system for joining a blade to a hub broadly comprises a blade slot in the hub, a rail system positioned within the blade slot, a root portion of a blade positioned within the slot, and a bumper cooperating with the rail and contacting a blade root portion.

A bumper for use in a blade attachment system in accordance with the present invention broadly comprises a central portion with first and second sides, a first pair of arms extending from the first side, a second pair of arms extending from the second side, and the central portion including means for axially positioning the bumper within a blade slot.

Other details of the hollow fan hub under blade bumper, as well as other objects and advantages attendant thereto, are set forth in the following detailed description and the accompanying drawings wherein like reference numerals depict like elements.

DETAILED DESCRIPTION OF THE PREFERRED EMBODIMENT(S)

Figure 1:
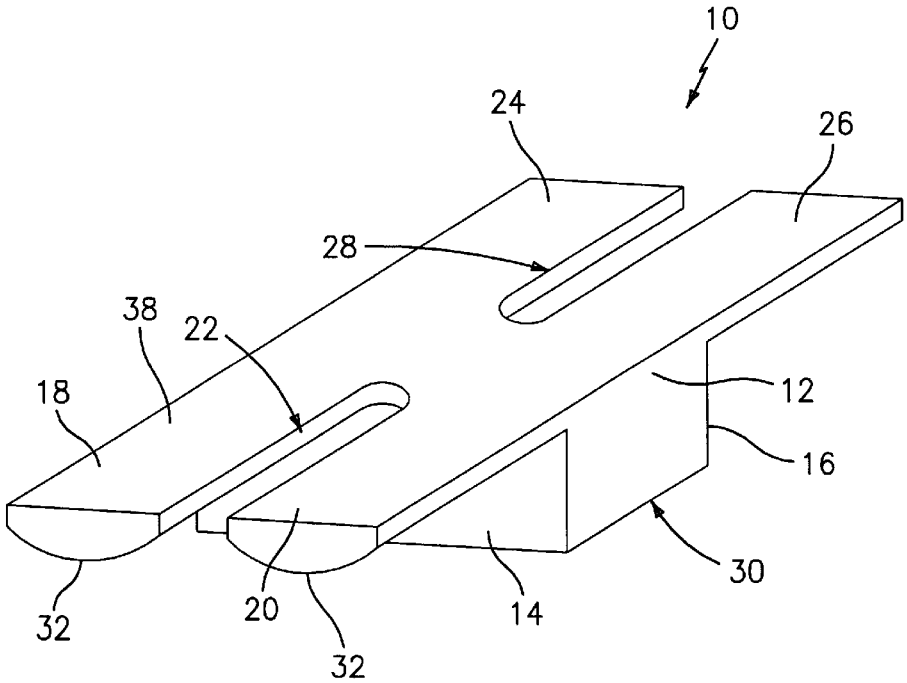
FIG. 1 is a perspective view of a hollow fan hub under blade bumper.

Referring now to the drawings, FIG. 1 illustrates an under blade bumper 10 in accordance with the present invention. The bumper 10 has a central portion 12 having a first side 14 and a second side 16. Extending from the first side 14 are first arm 18 and second arm 20. The arms 18 and 20 are separated by a first axial rail slot 22. Extending from the second side 16 are a third arm 24 and a fourth arm 26. The arms 24 and 26 are separated by a second axial rail slot 28. As can be seen from this figure, each slot 22 and 28 extends parallel to a longitudinal axis of the bumper 10.

The central portion 12 includes a tab 30 which extends below the lower surface 32 of the arms 18, 20, 24 and 26. As will be described in more detail later, the tab 30 is used to axially position the bumper 10 within a blade slot 34 of a hub 36.

The bumper 10 has an upper planar surface 38 which contacts the bottom surface 40 of a root portion 42 of a blade such as a fan blade. The lower surface 32 of each arm 18, 20, 24, and 26 is non-planar in configuration.

The bumper 10 may be made from any suitable material known in the art such as polyurethane.

Figure 2:
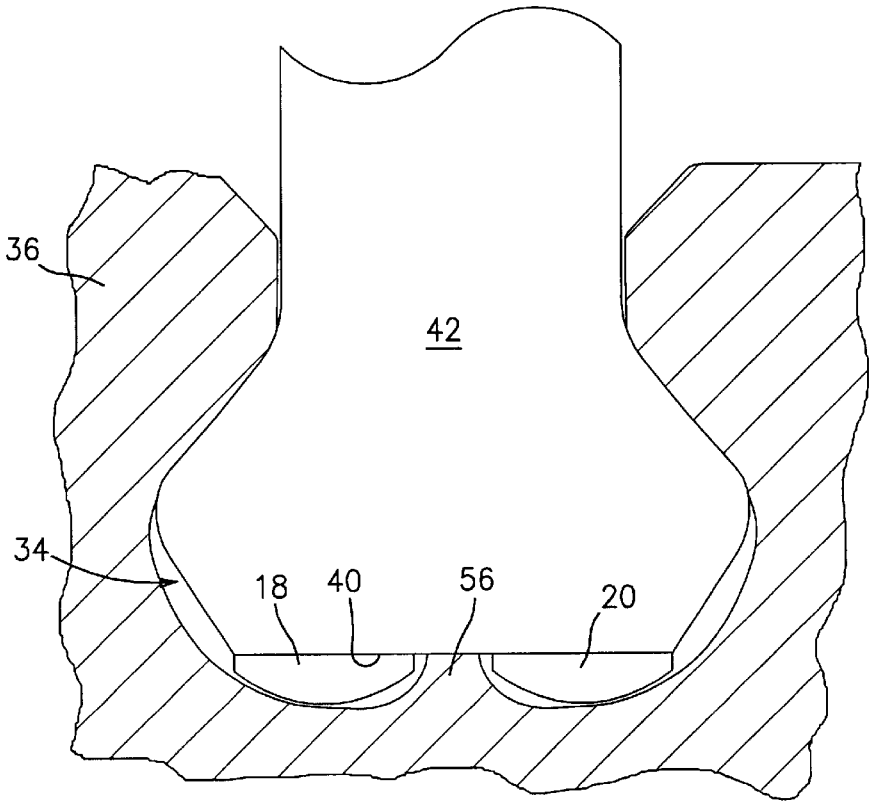
FIG. 2 illustrates a blade positioned within a blade slot having the under blade bumper of FIG. 1.
Figure 3:
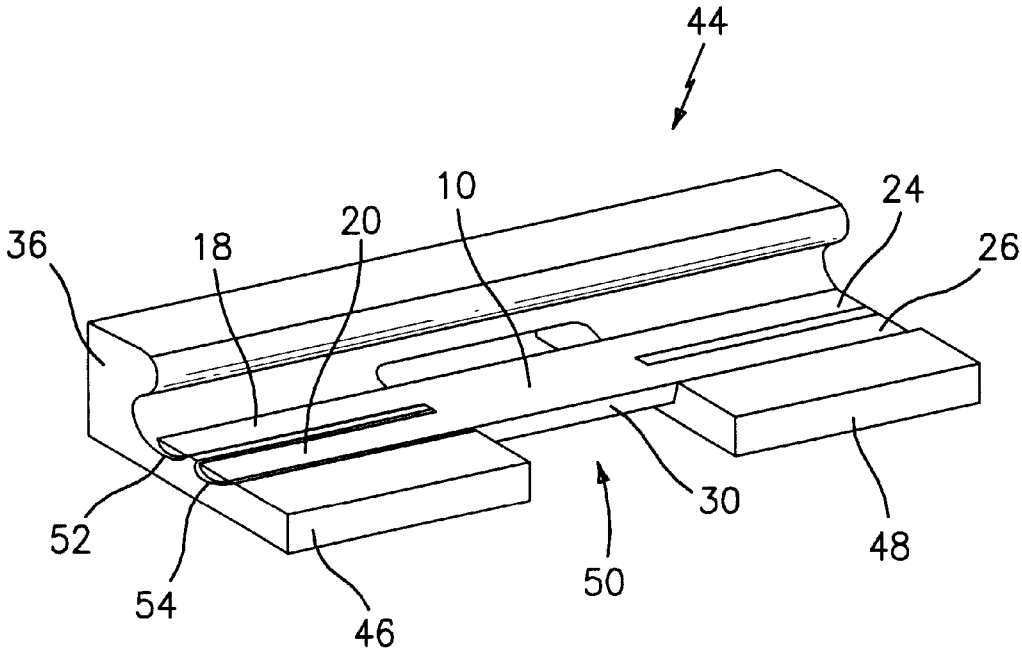
FIG. 3 illustrates a rail system used in a hub blade slot.

As shown in FIGS. 2 and 3, the blade slot 34 has a rail system 44. The rail system 44 includes first and second legs 46 and 48, respectively, separated by a gap 50. Each of the legs 46 and 48 includes first and second grooves 52 and 54 and a central rail 56 formed between the first and second grooves 52 and 54.

To install the bumper l0 within the blade slot 34, the bumper 10 is positioned on the legs 46 and 48 so that the tab 30 fits within the gap 50, the surfaces 32 of the arms 18, 20, 24 and 26 fit within the respective grooves 52 and 54, and the central rails 56 of the legs 46 and 48 fit into the slots 22 and 28.

One of the advantages to the bumper design of the present invention is that the bumper 10 can be installed without any processing required on the rails of the fan hub. Further, no bonding is required on the blade root. Still further, the bumper 10 minimizes movement in the fan blade to hub attachment reducing wear on the blade root and the fan hub attachment slot. This in turn reduces fan blade tip jams, blade shroud shingling, and premature fan hub retirement due to excessive wear.

It is apparent that there has been provided in accordance with the present invention a hollow fan hub under blade bumper which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications, and variations as fall within the broad scope of the appended claims.

What is claimed is:

1. An attachment system for joining a blade to a hub comprising:

a blade slot in said hub;

a rail system positioned within the blade slot;

said rail system having a first leg, a second leg, and a gap separating said first and second legs;

a root portion of the blade positioned within said slot; and a bumper cooperating with said rail system and contacting said blade root portion.

2. An attachment system according to claim 1, wherein said bumper has means for axially positioning said bumper within said blade slot.

3. An attachment system according to claim 2, further comprising:

said axial positioning means comprising a tab seated within said gap.

4. An attachment system according to claim 3, wherein each of said legs has two grooves and a central rail and said bumper has a pair of slots for receiving said central rails.

5. An attachment system according to claim 4, wherein said bumper has a substantially planar surface which contacts a lower surface of said blade root portion.

6. An attachment system according to claim 4, wherein said bumper has a plurality of spaced apart non-planar surfaces and each of said non-planar surfaces is seated within one of said grooves in said first and second legs.

7. A bumper for use in a blade attachment system, said bumper comprising:

a central portion with first and second sides;

a first pair of arms extending from said first side;

a second pair of arms extending from said second side; and said central portion including means for axially positioning said bumper within a blade slot.

8. A bumper according to claim 7, wherein said axial positioning means comprises a tab which extends below a lower surface of each said arm.

9. A bumper according to claim 7, further comprising each said arm and said central portion having a planar surface for contacting a lower surface of a blade root portion.

10. A bumper according to claim 7, wherein said first pair of arms includes a first arm and a second arm and a first slot separating said first and second arms and said second pair of arms includes a third arm and a fourth arm and a second slot separating said third and fourth arms.

11. A bumper according to claim 10, wherein each of said arms has a non-planar lower surface.

* * * * *